US007513833B1

(12) United States Patent
Town

(10) Patent No.: US 7,513,833 B1
(45) Date of Patent: Apr. 7, 2009

(54) GOLF SWING EYE TO HAND COORDINATION TRAINING AID

(76) Inventor: Gary Dale Town, 9705 NW. 29th Ave., Vancouver, WA (US) 98665

( * ) Notice: Subject to any disclaimer, the term of this patent is extended or adjusted under 35 U.S.C. 154(b) by 0 days.

(21) Appl. No.: 12/032,814

(22) Filed: Feb. 18, 2008

(51) Int. Cl.
*A63B 69/36* (2006.01)

(52) U.S. Cl. ..... 473/225; 473/219; 473/268

(58) Field of Classification Search ..... 473/219, 473/220, 221, 222, 225, 266, 268, 269, 278, 473/453; 434/252
See application file for complete search history.

(56) References Cited

U.S. PATENT DOCUMENTS

| | | | | |
|---|---|---|---|---|
| 4,139,198 | A | 2/1979 | Kanavas | |
| 5,080,362 | A | 1/1992 | Lillard | |
| 5,472,205 | A | 12/1995 | Bouton | |
| 5,538,250 | A | 7/1996 | Putz | |
| 5,692,965 | A | 12/1997 | Nighan, Jr. et al. | |
| 5,746,663 | A | 5/1998 | Calace | |
| 5,800,278 | A | 9/1998 | Varriano | |
| 6,821,211 | B2 * | 11/2004 | Otten et al. | 473/219 |
| 7,169,067 | B2 | 1/2007 | Town | |
| 2003/0104874 | A1 | 6/2003 | Galanis et al. | |
| 2004/0014531 | A1 | 1/2004 | Ziener-Gundersen | |
| 2004/0106092 | A1 | 6/2004 | Galanis et al. | |
| 2006/0199671 | A1 * | 9/2006 | Town | 473/417 |

* cited by examiner

*Primary Examiner*—Nini Legesse
(74) *Attorney, Agent, or Firm*—Bruce E. Harang

(57) ABSTRACT

A golf swing training aid which utilizes a microprocessor controlled set of colored LEDs to teach the user to focus on a point away from the ball through the contact of a golf club with the ball. Also shown is a method of providing a visual confirmation to the golfer that he has maintained focus on a point away from the ball during the swing and through impact with the ball. This golf swing training aid may also be mounted in a practice golf mat especially those of the type used at driving ranges.

18 Claims, 8 Drawing Sheets

GOLF SWING EYE TO HAND COORDINATION TRAINING AID

BACKGROUND OF THE INVENTION

1. Field of the Invention

The present invention generally relates to golf swing training apparatus. More specifically, the present invention relates to a training device that assists a user in attaining proper eye contact away from the ball during the golf club swing allowing the golfer to maintain a better swing posture thereby assisting in properly hitting the ball with the club head.

2. Description of the Related Art

Golf is one of the most popular sports games in the United States as well as many other parts of the world. One of the most difficult and yet most important requirements of the game is to keep the players eye contact on a single focus point until the ball has been hit by the head of the golf club. One of the most cherished maxims in sports is "keep your eye on the ball" during the swing. However, in golf that is not always the best way to learn or maintain a good swing that drives the head of the club through the ball. Instead there are a number of schools of thought on where the golfer should focus during the complete swing other than on the ball. These include a point directly behind the ball substantially in line with the target, a point directly in front of the ball substantially in line with the target, and a point in front of the ball and away from the golfer. The concept of focusing on a point other than the ball during the golf swing has been discussed as early as 1946 by Percy Boomer in his seminal golf instruction book On Learning Golf. More currently methods of achieving this non-ball focus point using methods such as "swing-oriented" swing techniques such as taught by James Powers PGA Professional; focusing on a point six to eight inches in front of the ball during the swing as taught by Jeremy Moreno PGA Professional; focusing several inches behind the ball as taught by Art Sellinger President of Long Drivers of America, and Duncan McGillivray Canadian Golf Professional; focusing on a point that is about 2.5 inches in front of and about 1.5 inches away from the golfer as taught by Jim Waldron PGA Professional. While there have been a number of mechanical devices as well as electronic devices designed to assist in improving the golf swing, none have provided a simple means to accomplish the goal of eye contact with a non-ball focus point until after the club head has hit and swung through the ball. However, "keep your eye on the ball" is still the most often recited instruction to golfers learning the game or working on their swing.

For example, U.S. Pat. No. 4,139,198 issued Feb. 13, 1979 to Kanavas, teaches a training device a golfer can attach to his putter to assist in developing accuracy and consistency in his putting.

U.S. Pat. No. 5,080,362 issued Jan. 14, 1992 to Lillard, teaches an impact-sensing device that visually signals the impact of a ball by the sporting implement to which it is attached.

U.S. Pat. No. 5,472,205 issued Dec. 5, 1995 to Bouton teaches an electronic device which is connected to a personal computer and which can determine the club head angle of a golf club as it is used to hit a golf ball and report the information to the personal computer.

U.S. Pat. No. 5,538,250 issued Jul. 23, 1996 to Putz teaches a mechanical golf ball sighting device for mounting on a golfer's hat brim. The device encourages the golfer to keep his head still and his focus on the ball until the club impacts the ball.

U.S. Pat. No. 5,692,965 issued Dec. 2, 1997 to Nighan Jr. et al. teaches a laser device attachable to a golf club shaft to provide a visual aid during a golf swing which is indicative of the user's position.

U.S. Pat. No. 5,746,663 issued May 5, 1998 to Calace teaches a mechanical device to be attached to a user by means of a mouthpiece for clamping by the user's teeth and to the user's belt at his back to physically restrain the user's head movement during a golf swing.

U.S. Pat. No. 5,800,278 issued Sep. 1, 1998 to Varriano teaches an infrared device for mounting on a user's head to align his eyes with the ball during a swing.

U.S. Patent Application Publication Number 2003/0104874 published Jun. 5, 2003 to Galanis et al. teaches a golf club head using an electronic infrared sensing system to determine and report the club head angle during a golf swing.

U.S. Patent Application Publication Number 2004/0014531 published Jan. 22, 2004 to Ziener-Gundersen teaches a device containing at least one microprocessor mountable upon a golf club using a LED or LCD display to show the swing of a club.

U.S. Patent Application Publication Number 2004/0106092 published Jun. 3, 2004 to Galanis et al. teaches an electronic infrared sensing system mounting in a golf club head to determine and report the club head angle during a golf swing.

U.S. Pat. No. 7,169,067 issued Jan. 30, 2007 to Town teaches an electronic device for assisting the golfer to focus on the ball during the swing.

There remains a need for a simple, easy to use device for training golfers to develop good eye-hand coordination and to keep eye contact with a predetermined point away from the ball through impact with the ball by a golf club head and completion of the swing without the need for mounting such a device on the golfer or on the golf club.

DISCLOSURE OF THE INVENTION

The present invention provides advantages and alternatives over the prior art by providing an eye to hand coordination golf swing training aid which is easy to use, adaptable to different non-ball focus points, is rugged, and inexpensive.

According to a further aspect of the present invention, there is provided a golf swing training apparatus teaching eye-hand coordination for impacting a golf ball comprising: a golf swing training aid comprising a base unit having located thereon a substantially cylindrical body and a ball holder positioned on one end of said substantially cylindrical body; a ball detecting apparatus in said swing training aid operable in a configuration for determining the presence or absence of a ball on said ball holder; and three separately located three colored indicator lights operable in a configuration to display a single color for a desired amount of time after the ball is impacted off of said ball holder located at three non-ball locations on the base unit, then turning off for a desired amount of time and finally displaying the same single color for a second desired amount of time; thereby allowing the user to determine if he focused on the selected non-ball focus point until after impacting the ball and completion of the swing.

According to yet another aspect of the present invention, there is provided a golf swing training apparatus teaching eye-hand coordination for impacting a golf ball comprising: a golf swing training aid comprising a base unit having located thereon a substantially cylindrical body and a ball holder positioned on one end of said substantially cylindrical body; a ball detecting apparatus in said swing training aid operable in a configuration for determining the presence or absence of a ball on said ball holder; and three separately located three colored indicator lights operable in a configuration to display a single color for a desired amount of time after the ball is impacted off of said ball holder located at three non-ball locations on the base unit, then turning off for a desired amount of time and finally displaying the same single color for a second desired amount of time; a switch for activating and deactivating said swing training aid; and a switch for selecting a desired non-ball focus point; thereby allowing the user to determine if he focused on the selected non-ball focus point until after impacting the ball and completion of the swing.

According to a yet further aspect of the present invention, there is provided a golf swing training apparatus teaching eye-hand coordination for impacting a golf ball comprising: a golf swing training aid comprising a base unit having located thereon a substantially cylindrical body and a ball holder positioned on one end of said substantially cylindrical body; a ball detecting apparatus in said swing training aid operable in a configuration for determining the presence or absence of a ball on said ball holder; and a parallax correcting position selectable module comprising three colored indicator lights operable in a configuration to display a single color for a desired amount of time after the ball is impacted off of said ball holder, then turning off for a desired amount of time and finally displaying the same single color for a second desired amount of time; a switch for activating and deactivating said swing training aid; and a switch for selecting a desired non-ball focus point; thereby allowing the user to determine if he focused on the selected non-ball focus point until after impacting the ball and completion of the swing.

The present invention thus advantageously provides a rugged, inexpensive, but highly effective non-ball focus point golf swing training aid.

DESCRIPTION OF THE PREFERRED EMBODIMENTS OF THE INVENTION

Figure 1:
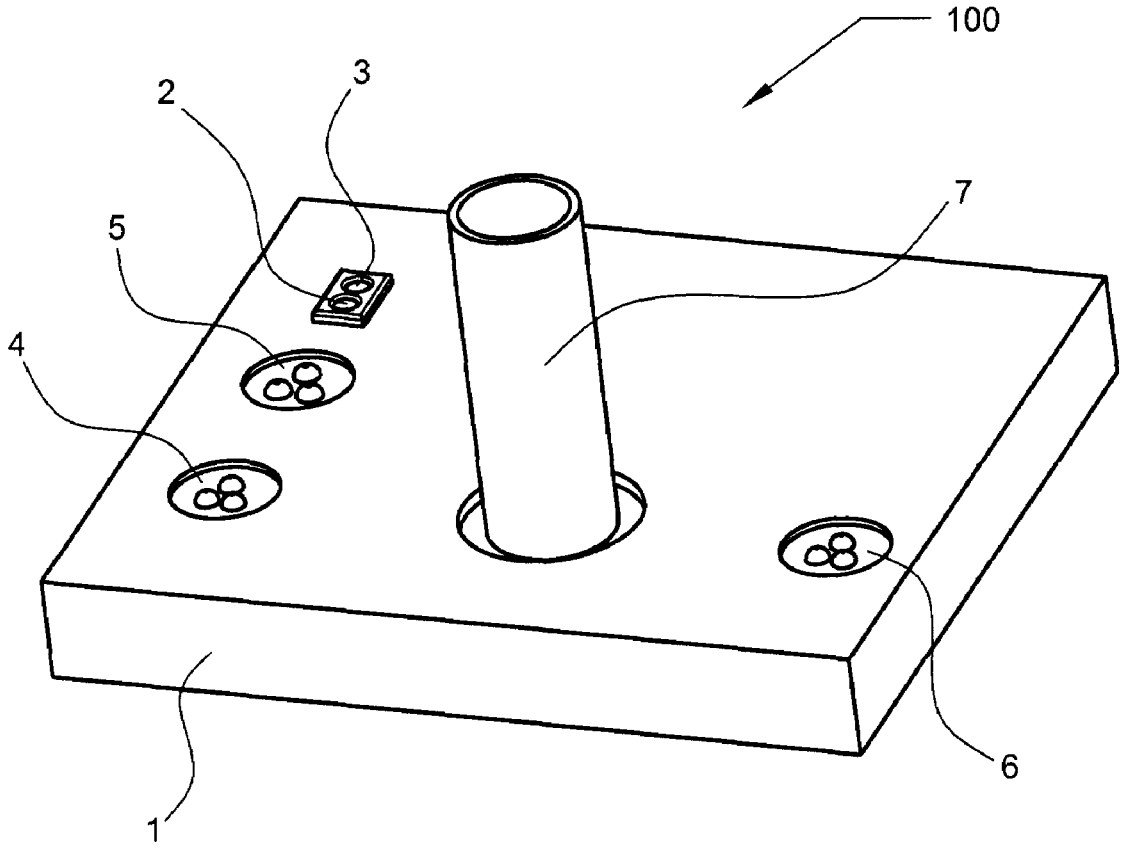
FIG. 1 shows a perspective view of one embodiment of a non-ball focus point golf swing training aid of the present invention.

Reference will now be made to the drawings, wherein to the extent possible like reference numerals are utilized to designate like components throughout the various views. Referring to FIG. 1, which presents a perspective view of one preferred embodiment of the present invention 100 have three fixed position focus points. As further shown in FIG. 1 are a base unit 1 having mounted therein a On/Reset switch 2; a Mode switch 3; a position 1 focus point three color LED cluster 4; a position 2 focus point three color LED cluster 5; a position 3 focus point three color LED cluster 6; and a flexible tubular golf ball tee stem 7.

Figure 2:
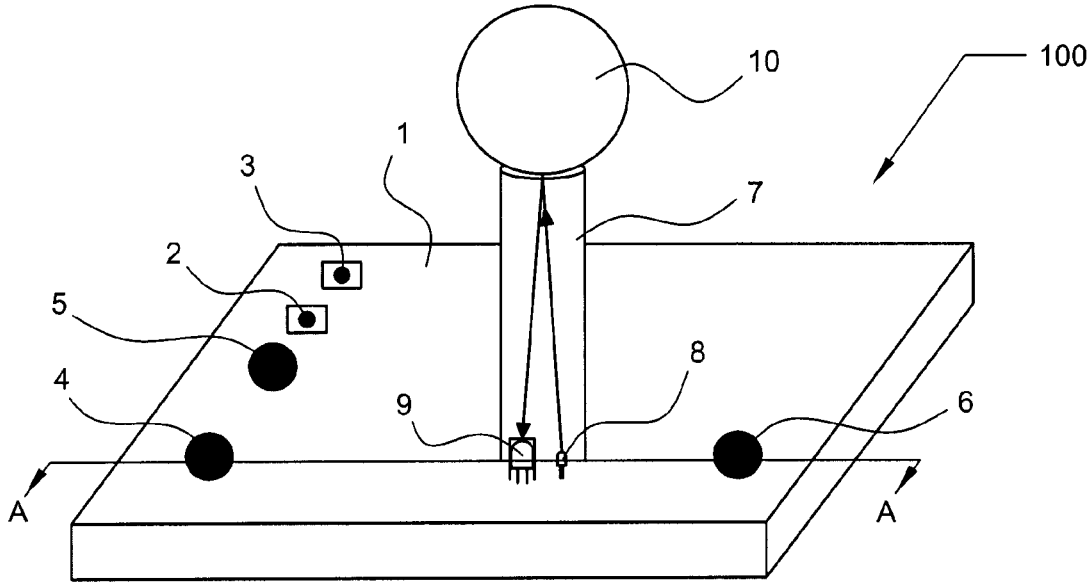
FIG. 2 shows a perspective schematic view of the embodiment of FIG. 1.

Referring now to FIG. 2; there is shown a perspective view of one embodiment of the present invention 100; comprising a base unit 1 having mounted therein a On/Reset switch 2; a Mode switch 3; a position 1 focus point three color LED cluster 4; a position 2 focus point three color LED cluster 5; a position 3 focus point three color LED cluster 6; a flexible tubular golf ball tee stem 7, (said flexible tubular golf ball tee stem having a ball mounting end; a tee mounting end; and a wall defining a bore through the longitudinal axis of said flexible tubular golf ball tee stem), replaceably mounted perpendicularly to the top surface of said base unit 1; having an infrared emitter transmitter 8 and an infrared photo transistor receiver 9 mounted within said base unit 1 so as to transmit and receive an infrared signal through the bore of the tubular of said flexible tubular golf ball tee stem 7; and having shown a golf ball 10 mounted upon the ball mounting end of said flexible tubular golf ball tee stem 7.

Figure 3:
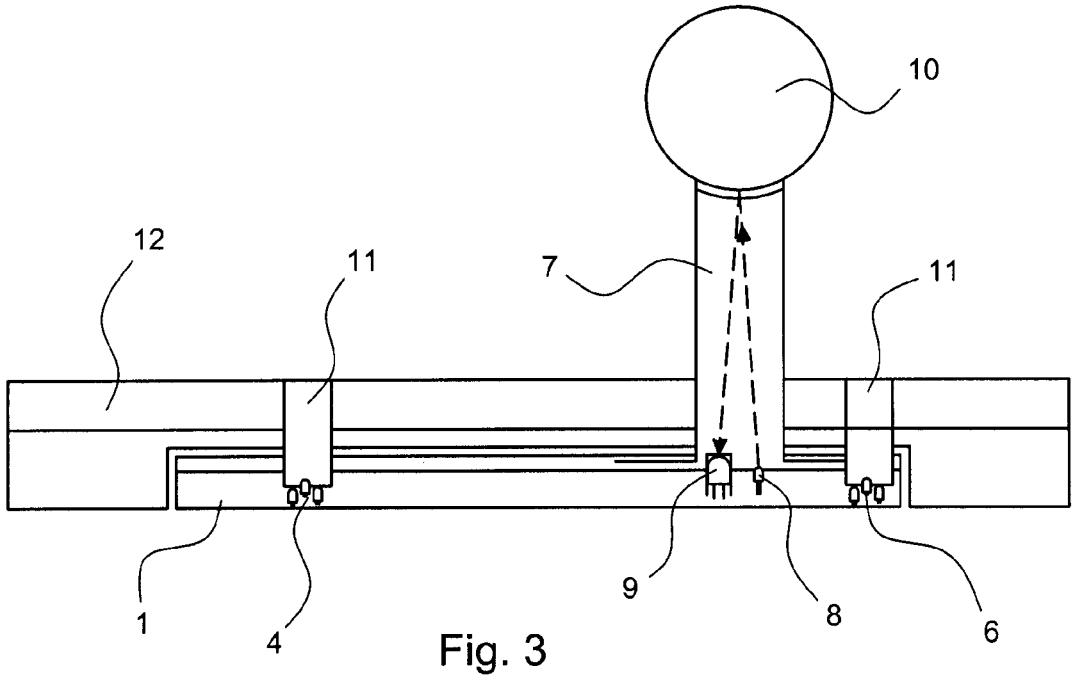
FIG. 3 shows a plan front view of the embodiment of FIG. 1 mounted in a golf turf pad.

FIG. 3 is a plan view through section line A-A of FIG. 2 showing a base unit 1 with focus point position 1 LED cluster 4; focus point position 3 LED cluster 6; wherein each focus point position LED cluster has a flexible black glare reducing tube 11 mounted over each said focus point position LED cluster 4 and 6; as well as showing flexible tubular golf ball tee stem 7 with infrared emitter transmitter 8 and a infrared Photo transistor receiver 9 mounted within said base unit 1 so as to transmit and receive an infrared signal through the bore of the tubular of said flexible tubular golf ball tee stem 7; the complete unit mounted in a golf turf pad 12 designed to receive said base unit 1 therein.

Figure 4:
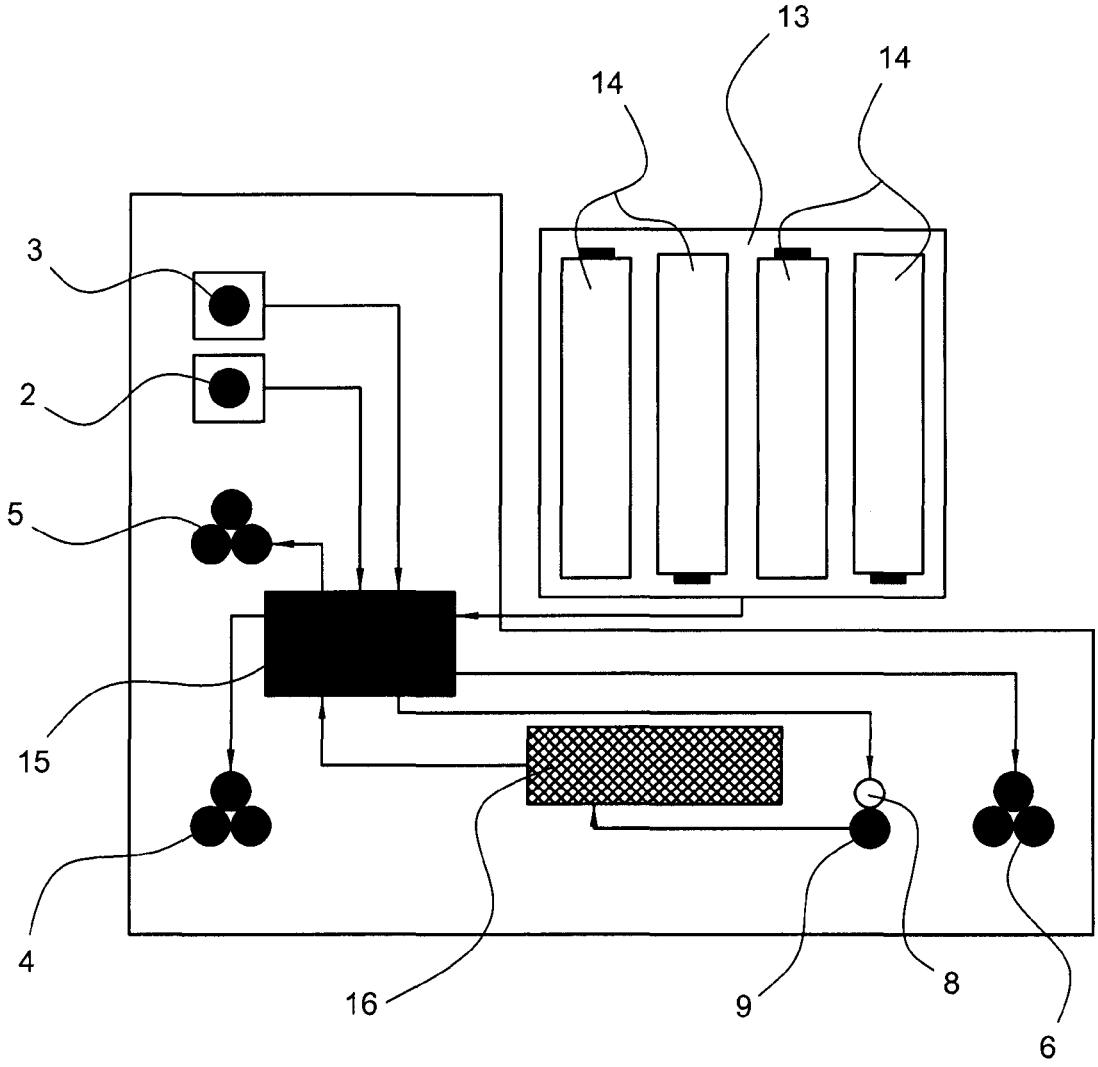
FIG. 4 shows a block diagram of one embodiment of a non-ball focus point golf swing training aid of the present invention.

Referring to FIG. 4; there is illustrated a block diagram of the embodiment of the present invention of FIG. 1 showing one embodiment of the electrical circuitry of the present invention including the Power/Reset switch 2; Mode switch 3; a position 1 focus point three color LED cluster 4; a position 2 focus point three color LED cluster 5; a position 3 focus point three color LED cluster 6; an infrared emitter transmitter 8 and an infrared photo transistor receiver 9; a battery compartment 13 mounted within a base unit 1 for mounting batteries 14; a microcontroller 15; and a ball sensor receiver circuit 16 all electrically connected via appropriate wiring.

Figure 5:
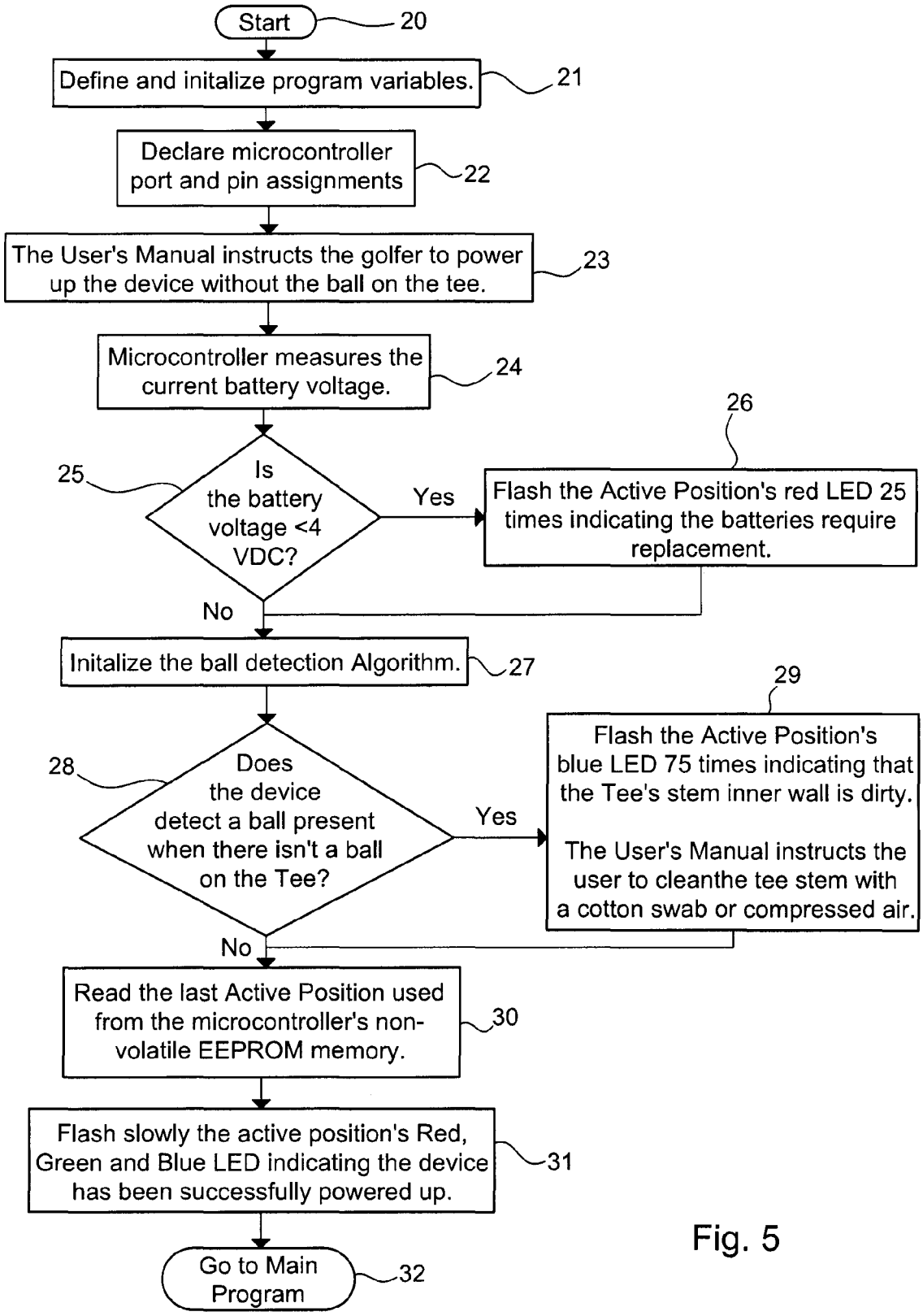
FIG. 5 shows a schematic of the power up and reset algorithm used by the micro controller of the non-ball focus point golf swing training aid of the present invention.

Turning now to FIG. 5 there is shown a block diagram of the microcontroller procedure used to power up the present invention comprising the steps of starting the procedure 20; defining and initializing the program variables 21; declaring microcontroller port and pin assignments 22; all without a ball on the tee 23; then the microcontroller measures the current battery voltage 24; to determine if the battery voltage is <4 VDC; if yes the active position's red LED flashes 25 times to indicate the need to replace the batteries 26; when no the ball detection algorithm is initiated 27; next the presence of a ball on the tee is determined 28; if yes and there is yet no ball mounted the active position's blue LED flashes 75 times to indicate that the Tee's inner stem wall is dirty and requires cleaning; if no ball is detected the last active position used is read from the EEPROM memory 30; all three colored lights flash slowly to indicate the device has been successfully powered up 31; the device microcontroller proceeds to the main program 32.

Figure 6:
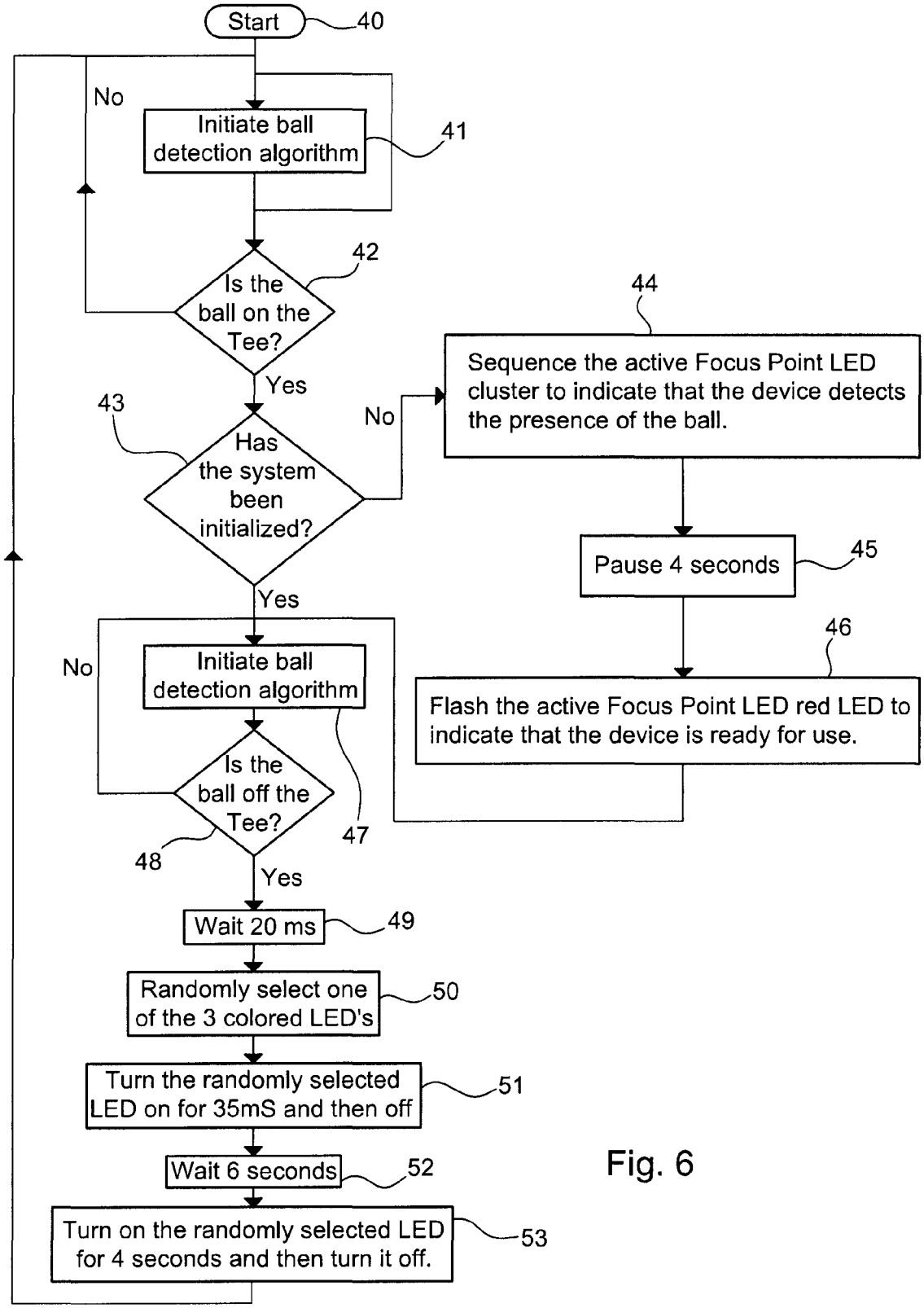
FIG. 6 shows a schematic of the main program algorithm used by the micro controller of the non-ball focus point golf swing training aid of the present invention.

FIG. 6 shows a block diagram of the microcontroller main program comprising the steps of starting the main program 40; initiating the ball detection algorithm 41; determining if a ball is present 42; if no return to step 41 and repeat; if yes has the system been initialized 43; if no then sequence the active focus point LED cluster to indicate that the device detects the presence of the ball 44; pause for 4 seconds 45; flash the active focus point red LED to indicate the device is ready to use 46; if yes for step 43 initiate the ball detection algorithm 47; if step 48 returns a no then proceed to step 47; after step 47 is completed proceed to step 48 to determine if the ball has come off the tee; if yes wait 20 ms 49; then randomly select one of the 3 LED colors 50; turn the randomly selected LED color of step 50 on for 35 ms and then turn off 51; wait 6 seconds 52; then turn on the randomly selected LED for 4 seconds and then turn it off 53; return to step 41.

Figure 7:
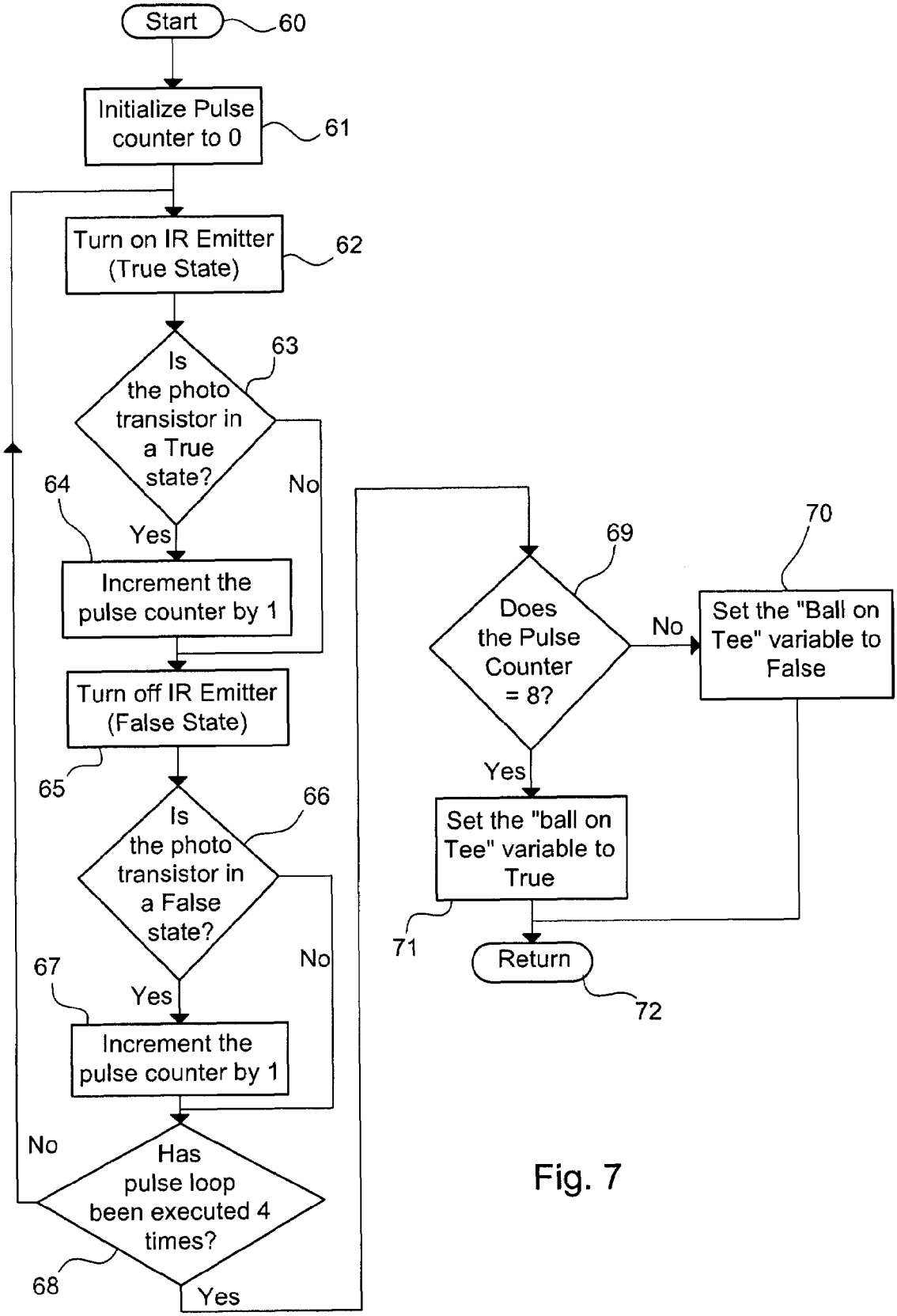
FIG. 7 shows a schematic of the ball detection algorithm used by the micro controller of the non-ball focus point golf swing training aid of the present invention.

FIG. 7 shows a block diagram of the ball detection algorithm comprising the steps of starting the procedure 60; initializing the pulse counter to zero 61; turn on IR emitter (true state) 62; is the photo transistor in a true state 63; if no skip step 65; if yes increment the pulse counter by one 64; then turn off the IR Emitter (false state) 65; determine if the photo transistor is in a false state 66; if no skip to step 68; if yes increment the pulse counter by one 67; then check to see if the pulse loop has been executed 4 times 68; if no return to step 62 and if yes check to see if the pulse counter equals eight 69; if no set the "ball on tee" variable to false 70 and move to return 72; and if yes set the "ball on tee" variable to true 71 and move to return step 72.

Figure 8:
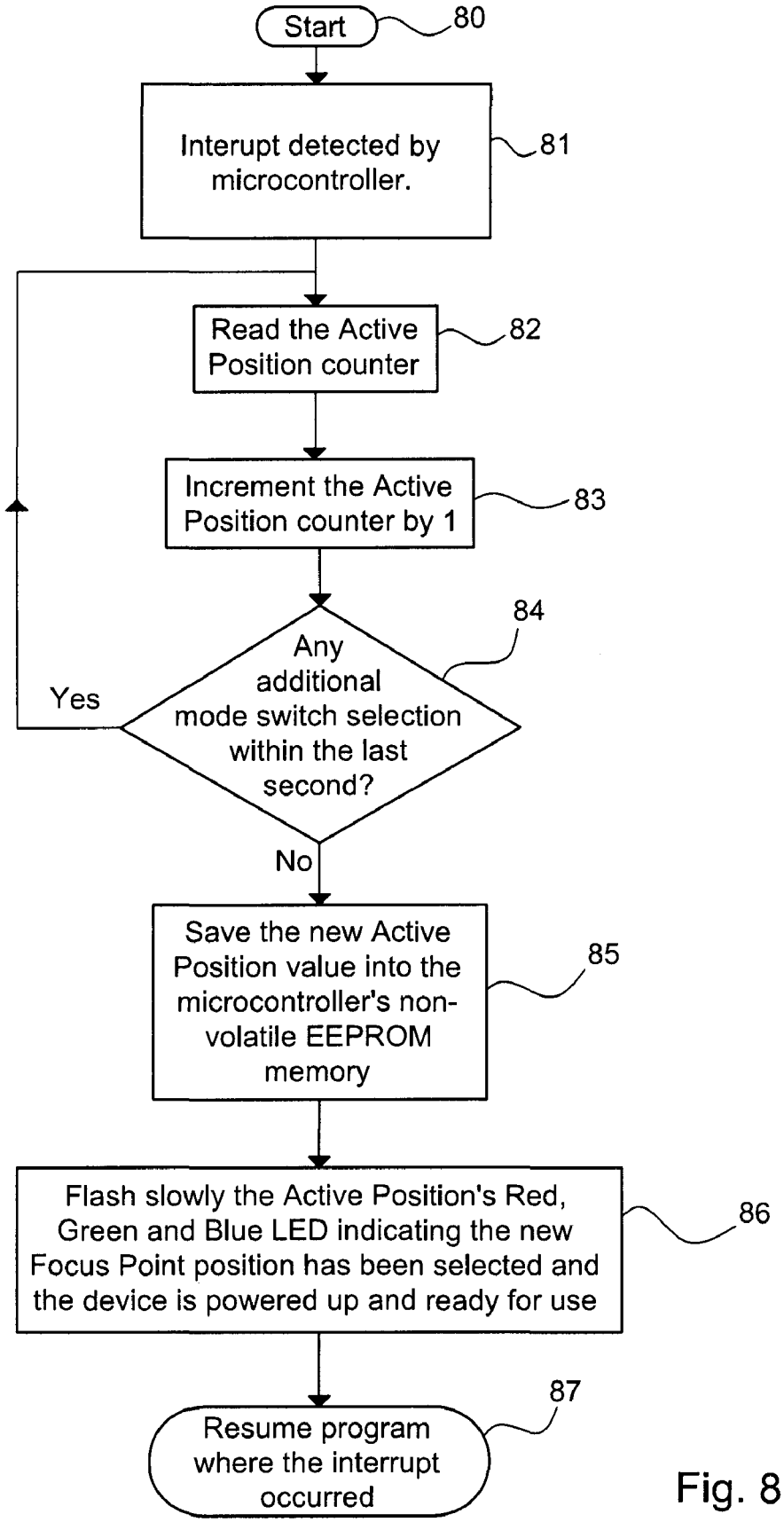
FIG. 8 shows a schematic of the mode selection interrupt handler algorithm used by the micro controller of the non-ball focus point golf swing training aid of the present invention.

FIG. 8 shows a block diagram of the mode selection interrupt handler comprising the steps of starting the program 80; when an interrupt is detected by the microcontroller then read the active position counter 82; then increment the active position counter by one 83; now check to see if there have been any additional mode switch selections within the last second 84; if yes return to step 82; if no save the new active position value into the microcontroller's non-volatile EEPROM memory 85; then flash the active position's three colored LED indicating the new focus point position has been selected and the device is powered up and ready to use 86; and resume the program where the interrupt occurred 87.

Figure 9:
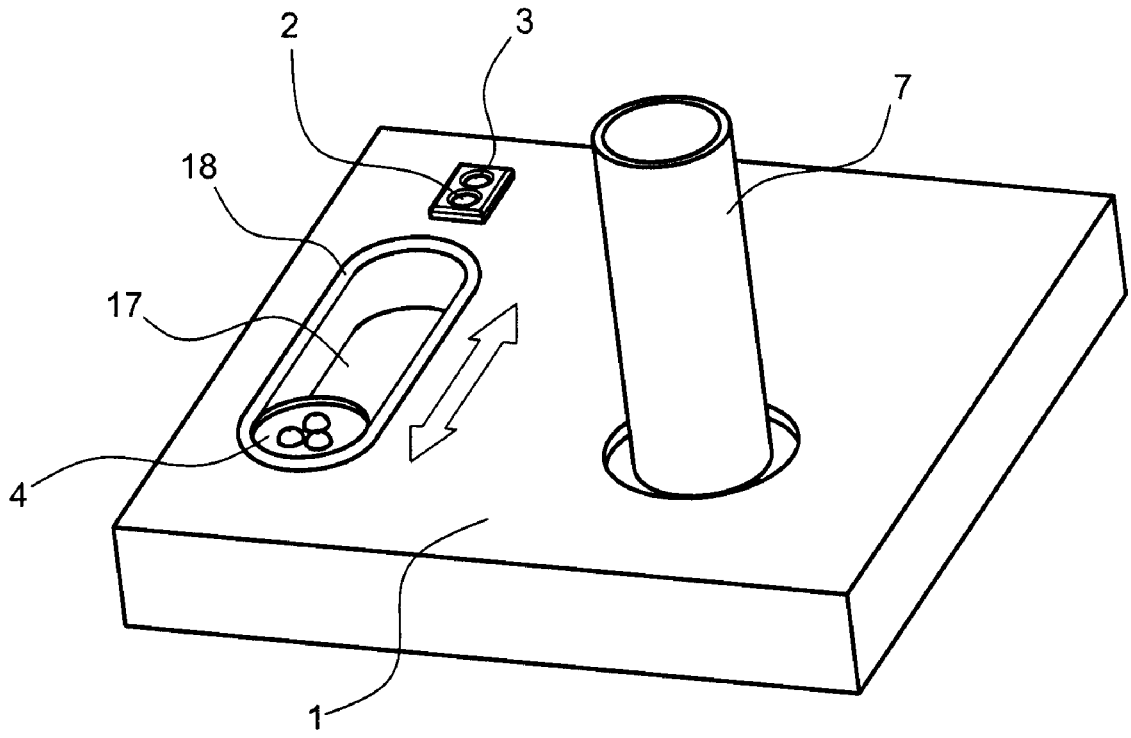
FIG. 9 shows a perspective view of a parallax correcting embodiment of a non-ball focus point golf swing training aid of the present invention.

FIG. 9 shows a perspective view of another preferred embodiment of the present invention 100 including a base unit 1 having mounted therein a On/Reset switch 2; a Mode switch 3; a single focus point three color LED cluster 4 mounted on moveable slide 17, said cluster 4 and slide 17 moveable within base unit 1 focus point positioning track 18; and a flexible tubular golf ball tee stem 7.

In practice; the golfer, before powering the training aid of the present invention on, ensures that there is no ball or other object on the tee.

Then the training aid of the present invention is turned on using the ON/Reset switch which will wake the training aid of the present invention from the powered downed sleep mode it normally resides in when not in use.

At power up, the training aid of the present invention will indicate acceptable battery life by flashing the active focus point LED position's green LED. If the battery level is not acceptable, below 4 volts DC, the red LED of the active focus point will flash rapidly. After a low battery condition has been detected, the training aid of the present invention will attempt normal operation. The golfer, should however, replace the low batteries to ensure proper operation of the training aid of the present invention.

After the battery check the training aid of the present invention will next perform a ball detection self check. If the training aid of the present invention detects an object during this self check, when there is no ball or other object present on the tee, the training aid of the present invention will indicate this ball detection error by flashing the active focus point blue LED rapidly for an extended period of time. If the training aid of the present invention fails this self check, clean the sensor and tee stem inner wall with a cotton swab or compressed air. After cleaning the training aid of the present invention, the golfer selects the Reset/On switch again to restart the training aid of the present invention. The golfer ensures that there is no ball or other object on the tee before restarting the training aid of the present invention. The ball detection sensor is located at the base of the inner tee stem. If too much dirt or debris lines the inner tee wall the training aid of the present invention will falsely detect the presence of the ball.

The golfer then chooses one of the focus point positions (1, 2, or 3) by pressing the Mode Switch after the training aid of the present invention has been successfully powered up. In the case of the embodiment of the moveable focus point the golfer chooses the position to correct the parallax for the club and swing position that will be practiced. The training aid of the present invention will illuminate the focus point's red LED indicating that this focus point has been successfully selected. The golfer will select the focus point based on the desired golf instruction philosophy and their current golf swing mechanics. The focus point is the place where one of the three LED cluster is located. The golfer's eyes will then focus on this position point instead of the ball.

Now the golfer places a golf ball on the tee. The training aid of the present invention will flash the active focus point LEDs in a red, green and blue sequence to indicate that the training aid of the present invention detects the presence of the golf ball and that all three LEDs are functional.

After approximately four seconds, during which the golfer gets into the desired swing position, the training aid of the present invention will flash the active focus point's red LED six times indicating that the device has been initialized and is ready for use.

The golfer's eyes are focused on the activated focus point and not the ball. Preferably, the golfer maintains indirect visual contact with the ball using peripheral vision.

The golfer's swing is initiated.

Almost immediately after the ball has been hit, one of the three colored LED's will be randomly chosen by the training device microprocessor and flashed for a fraction of a second. If the golfer has kept his eyes on the focus point, the golfer will see the LED flash and will be able to determine the color of the randomly flashed LED. However, if the golfer has moved his eyes or head and thereby lost visual contact with the selected focus point he will not be able to identify the color flashed by the focus point LEDs.

Approximately four seconds after the ball is hit and the randomly chosen color LED is flashed, the same color LED will be lighted for approximately five seconds. Thus the golfer has approximately four seconds to identify the randomly chosen color flashed by the LEDs before the confirmation lighting of the same color takes place.

To continue practicing the golfer places another ball on the tee and the process is repeated from this same point in the description above.

Another situation that the present invention addresses is the fact that with different tee heights for positioning the ball for different types of clubs can be an amount of parallax error introduced into the sight picture of the golfer. For example the height of the tee and therefore the ball when teed up for a wood is different from the height of the ball when using an iron or putter. This parallax error requires correction to allow the golfer to view the focus point in-line with the ball and the cup for various tee heights. By moving the position of the focus point which is in front of the ball closer or farther away from the ball on an axis perpendicular to the flight line of the ball allows the golfer to automatically correct for the parallax error introduced by changing the height of the ball off of the turf. Applicant has found that a movement along this line perpendicular to the line of flight of the ball of from about 0 inches to about 1.75 inches corrects parallax error resulting from a ball sitting on the turf to one placed on a tee of up to about 3 inches in height.

The present invention may be constructed of plastics commonly used to produce golf tees and the like. Such plastics include for example; polypropylene; butylenes and the like; as well as plastics used for such items as super balls which provide a dense; shock absorbing medium to protect the internal components of the present invention from damage due to shock.

The training aid of the present invention may be used alone or preferably it is first mounted under a golf mat that so as to more closely imitate actual golfing conditions and to protect the training device from unnecessary physical impact by the golfer's club. There is no special requirements for a golf mat for use with the training aid of the present invention other than it have opening to allow the golfer to see the focus point LEDs, access the switches, and mounting the tee in the training device of the present invention for holding the golf ball. The presently preferred golf mat is Fiberbuilt golf mat produced by Fiberbuilt Manufacturing Inc. of Calgary, Alberta, Canada which has been modified to meet the above requirements.

Although the preferred embodiments of the present invention have been disclosed; various changes and modifications may be made without departing from the scope of the invention as set forth in the appended claims.

What is claimed is:

1. A golf training apparatus for teaching eye-hand coordination for impacting a golf ball using a golf club comprising:

a golf swing training aid comprising in cooperative combination;

a substantially boxed shape training apparatus having a top surface, bottom surface, and at least one side surface;

a substantially cylindrical body capable of mounting a ball on one end, removably mounted to said top surface of said training apparatus;

a golf ball detecting apparatus in said golf training apparatus operable in a configuration for determining the presence or absence of a ball on said substantially cylindrical body ball mounting end; and at least one focus point assembly having three colored indicator lights operable in a configuration to display a single color for a desired amount of time after the ball is impacted off of said substantially cylindrical body, then turning off said single color indicator light for a desired amount of time and finally displaying the same single color indicator light for a second desired amount of time, said at least one focus point assembly being positioned at a desired location away from the ball;

thereby allowing the user to determine if he focused on the focus point located away from the ball until after impacting the ball.

2. A golf swing training aid as claimed in claim 1 wherein, there is one focus point assembly positioned at a desired location behind the substantially cylindrical body capable of mounting a ball thereon.

3. A golf swing training aid as claimed in claim 1 wherein, there is one focus point assembly positioned at a desired location in front of the substantially cylindrical body capable of mounting a ball thereon.

4. A golf swing training aid as claimed in claim 1 wherein, there is more than one focus point assembly positioned at desired locations in front of the substantially cylindrical body capable of mounting a ball thereon.

5. A golf swing training aid as claimed in claim 1 wherein, there is one focus point assembly positioned behind, and at least one focus point assembly positioned in front of, the substantially cylindrical body capable of mounting a ball thereon.

6. A golf swing training aid as claimed in claim 1 wherein, there are three focus point assemblies positioned at desired locations in front of, the substantially cylindrical body capable of mounting a ball thereon.

7. A golf swing training aid as claimed in claim 1 wherein, there is one focus point assembly positioned directly behind, and three focus point assemblies positioned at desired locations in front of, the substantially cylindrical body capable of mounting a ball thereon.

8. A golf swing training aid as claimed in claim 1 wherein, said golf swing training aid is dimensioned to fit in an appropriately dimensioned cavity on the underside of a golf mat such that said at least one focus point assemblies and said substantially cylindrical body capable of mounting a ball thereon protrude a desired distance above the top surface of said conventional golf mat.

9. A golf swing training aid as claimed in claim 1 wherein, said golf ball detecting apparatus comprises an infrared emitter and corresponding infrared detector.

10. A golf swing training aid as claimed in claim 1 wherein, said golf ball detecting apparatus comprises an ambient light photo detector.

11. A golf swing training aid as claimed in claim 1 wherein, said three colored indicator lights are three separate single color light emitting diodes (LED).

12. A golf swing training aid as claimed in claim 1 wherein, said three colored indicator lights are a single tricolor light emitting diode (LED) capable of emitting three separate colors of light.

13. A golf training apparatus for teaching eye-hand coordination for impacting a golf ball using a golf club comprising:

a golf swing training aid comprising in cooperative combination;

a substantially boxed shape training apparatus having a top surface, bottom surface, and at least one side surface;

a substantially cylindrical body capable of mounting a ball on one end, removably mounted to said top surface of said training apparatus;

a golf ball detecting apparatus in said golf training apparatus operable in a configuration for determining the presence or absence of a ball on said substantially cylindrical body ball mounting end; and a single focus point assembly moveable along a predetermined track in front of the substantially cylindrical body having three colored indicator lights operable in a configuration to display a single color for a desired amount of time after the ball is impacted off of said substantially cylindrical body, then turning off said single color indicator light for a desired amount of time and finally displaying the same single color indicator light for a second desired amount of time, said at least one focus point assembly being positioned at a desired location away from the ball;

thereby allowing the user to correct for parallax error for the desired tee height and to determine if he focused on the focus point located away from the ball until after impacting the ball.

14. A golf swing training aid as claimed in claim 13 wherein, said golf swing training aid is dimensioned to fit in an appropriately dimensioned cavity on the underside of a conventional golf mat.

15. A golf swing training aid as claimed in claim 13 wherein, said golf ball detecting apparatus comprises an infrared emitter and corresponding infrared detector.

16. A golf swing training aid as claimed in claim 13 wherein, said golf ball detecting apparatus comprises an ambient light photo detector.

17. A golf swing training aid as claimed in claim 13 wherein, said three colored indicator lights are three separate single color light emitting diodes (LED).

18. A golf swing training aid as claimed in claim 13 wherein, said three colored indicator lights are a single tri-color light emitting diode (LED) capable of emitting three separate colors of light.

* * * * *